US006722582B2

(12) United States Patent
Hess et al.

(10) Patent No.: US 6,722,582 B2
(45) Date of Patent: Apr. 20, 2004

(54) LIQUID DROPLET SPRAY DEVICE

(75) Inventors: Joseph Hess, Bevaix (CH); Bo Hu, Peseux (CH); Philippe Luginbühl, Nods (CH); Jean-Marc Flick, Savagnier (CH)

(73) Assignee: Microflow Engineering SA, Neuchatel (CH)

( * ) Notice: Subject to any disclaimer, the term of this patent is extended or adjusted under 35 U.S.C. 154(b) by 29 days.

(21) Appl. No.: 10/232,815

(22) Filed: Sep. 3, 2002

(65) Prior Publication Data

US 2003/0080214 A1 May 1, 2003

(30) Foreign Application Priority Data

Sep. 3, 2001 (EP) ..... 01121075

(51) Int. Cl.[7] ..... B05B 1/08

(52) U.S. Cl. ..... 239/102.2; 239/552; 239/596; 239/601; 239/DIG. 19

(58) Field of Search ..... 239/102.1, 102.2, 239/548, 552, 596, 601, DIG. 19

(56) References Cited

U.S. PATENT DOCUMENTS

| | | | | |
|---|---|---|---|---|
| 5,152,456 A | * | 10/1992 | Ross et al. | 239/102.2 |
| 5,261,601 A | * | 11/1993 | Ross et al. | 239/102.2 |
| 5,823,428 A | * | 10/1998 | Humberstone et al. | 239/601 |
| 6,036,105 A | | 3/2000 | Sanada et al. | |
| 6,405,934 B1 | * | 6/2002 | Hess et al. | 239/102.2 |

FOREIGN PATENT DOCUMENTS

| | | |
|---|---|---|
| EP | 0 516 565 A1 | 12/1992 |
| EP | 0 923 957 A1 | 6/1999 |
| EP | 1 005 917 A1 | 6/2000 |
| WO | WO 95/15822 | 6/1995 |

* cited by examiner

*Primary Examiner*—Steven J. Ganey
(74) *Attorney, Agent, or Firm*—Griffin & Szipl, PC

(57) ABSTRACT

The invention concerns a liquid droplet spray device for atomising a liquid substance, comprising a housing comprising a first substrate, a second substrate superposed on the first substrate and a space enclosed by said first and second substrates for containing the liquid substance.

5 Claims, 2 Drawing Sheets

LIQUID DROPLET SPRAY DEVICE

Figure 1:
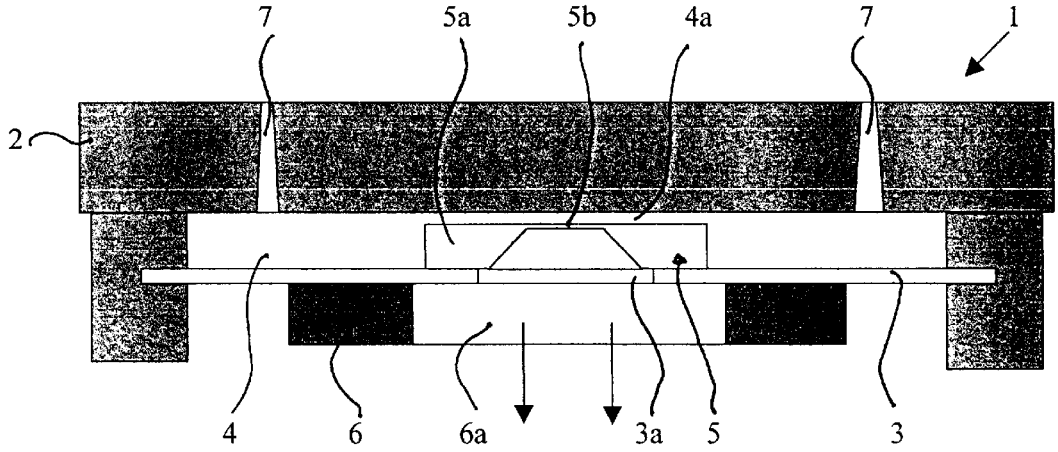

The present invention relates to a liquid droplet spray device suitable for atomising a liquid substance such as a drug, a fragrance or other atomised liquids. Such a device may be used, e.g., for perfume dispensers or for administrating an atomised or nebulised drug to a patient by means of his or her respiratory system. Such a device, in its simplest form, is commonly called an atomizer. The device delivers the liquid substance as a dispersion of atomised droplets. More specifically, the present invention concerns an improved liquid droplet spray device that efficiently creates and expels a controllable liquid droplet spray.

Various liquid droplet spray devices are known for atomising a liquid. For instance, the document EP 0 516 565 describes an ultrasonic wave nebuliser which atomises water. This apparatus is used as a room humidifier. Vibration is transmitted through the water to the water surface from which the spray is produced. A perforate body is provided to retain the water in absence of oscillation.

Typically, inhaler devices use the same principle to atomise the liquid substance into droplets, see for example the document WO 95/15822.

As is known, the droplet size depends on the size of the outlet orifices of the perforate membrane, and also depends on the vibration frequency. In order to obtain a small droplet, a very high frequency should be used, typically over 1 MHz for droplets of about 10 $\mu$m in diameter. Generally, the higher the frequency, the smaller the droplet diameter may be. This leads to increased power consumption due to the high frequency so that such a device is not suitable for a small battery operated device.

Another liquid droplet spray device is known from the document EP-A-0 923 957 in the name of the present Applicant. The described liquid droplet spray device consists of a housing formed of a superposition of a first substrate and a second substrate in-between which a chamber or a space is formed for containing a liquid substance and thus providing a compression chamber. Outlet means are provided in a thinner body section of the first substrate. The outlet means consists of a cavity, which partly constitutes the chamber, outlet nozzles and output channels connecting these nozzles to the chamber. The liquid substance enters the chamber or space of spray device by way of, e.g., a very low pressure, e.g., around a few millibars, or capillary action. The spray device further comprises a vibrating element, e.g. a piezoelectric element to cause vibration of the liquid substance in the space. By vibrating the liquid substance, the liquid enters the outlet means and a droplet spray is generated as the liquid is expelled from the device.

This prior art document further describes techniques allowing for such output channels with a straight, non-tapered profile. This provides for a precisely defined pressure drop, droplet size and flow behaviour across the output channel for aqueous solutions and suspensions whereas the relatively smooth surface is suited for medications carrying small solid particles, e.g. from less than 1 to approx 2 $\mu$m, in suspensions. The same effect can be obtained proportionally with larger dimensions, e.g. with nozzles of 10 $\mu$m or larger for example for perfume dispensing applications.

The diameter of an expelled droplet depends on the nozzle hole size "d" for a given frequency of the vibration of the liquid substance and the inlet pressure. In this prior art device where a frequency of around 243 kHz is used, the mean droplet diameter has been found to be around 5 $\mu$m, the diameter of the hole of the outlet nozzle is around 7 $\mu$m and the inlet pressure is a few millibars. One such a droplet thus contains a quantity of around 67 femtoliters ($10^{-15}$ l) so that as such the number of nozzles may be determined as a function of the amount to be ejected.

Indeed, the fabrication tolerance $\Delta d$ of the outlet nozzles is an essential factor in controlling and determining the amount, i.e. the volume "V" of an expelled droplet. In fact, this volume V depends on $d^3$ ($V=\frac{1}{6}*\Pi d^3$), d being the diameter of the outlet nozzle.

For example, if d=5 $\mu$m, and $\Delta d=\pm 0.5$ $\mu$m, the droplet volume V may vary from 47.5 (d=4.5) to 87 (d=5.5) which is a variation of 83%.

Furthermore, it is known that the pressure drop across the output channel depends on $d^4$, so it may be understood that the outlet diameter, the channel diameter, its cross-section, as well as any combination of varying micro-machined cross-sections of the outlet channel and nozzle are an important factor in the structure of the liquid droplet spray device.

It is also known that the droplet diameter varies with certain physico-chemical properties of the liquid such as surface tension and viscosity. It is therefore important as shown in the cited prior art to be able to adapt the physical and electrical device parameters (frequency and amplitude) according to the liquid to be expelled and the desired droplet characteristics.

In fact, as can be understood from above, the outlet means need to be manufactured with a very high precision and very low tolerance. This leads to a relatively expensive device.

The applicant has now found that although the prior art device generally functions satisfactorily, the construction of this device has limits if it needs to be manufactured in a cheap manner thereby still ensuring sufficient rigidity and precision when manufacturing the outlet means.

It is, therefore, an object of the present invention to provide a liquid droplet spray device which overcomes the above-mentioned inconveniences.

It is another object of the present invention to provide such a device that is simple, reliable and inexpensive to manufacture, small in size and low in energy consumption and cost.

Thus, the present invention concerns a liquid droplet spray device as defined in the appended claims.

Thanks to the construction of the spray device according to the present invention an efficient device may be obtained in a relatively simple and inexpensive manner.

Figure 2:
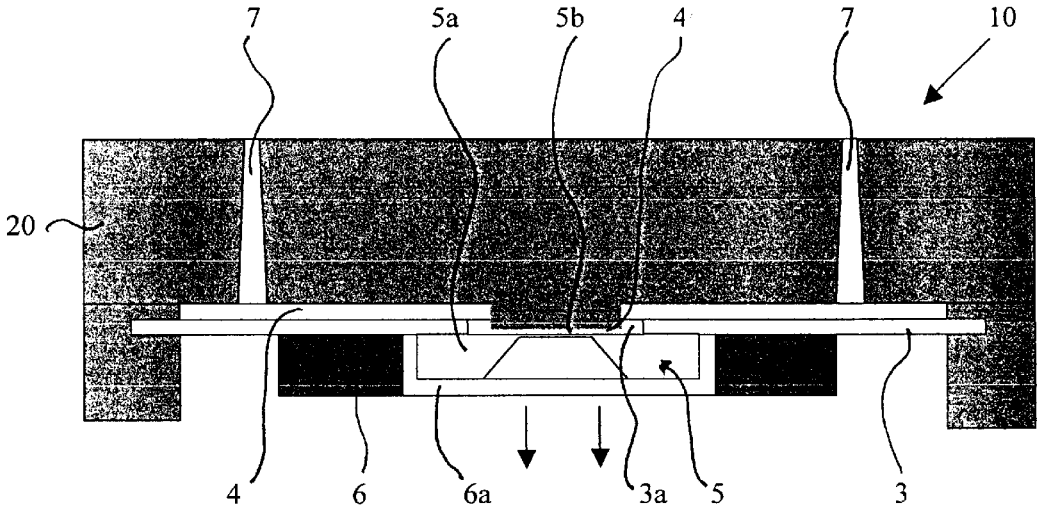
Figure 3:
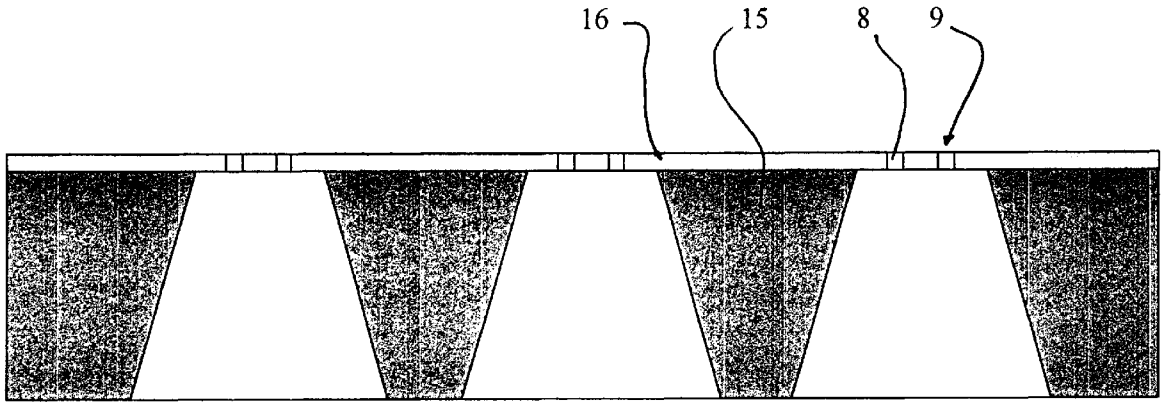
Figure 4:
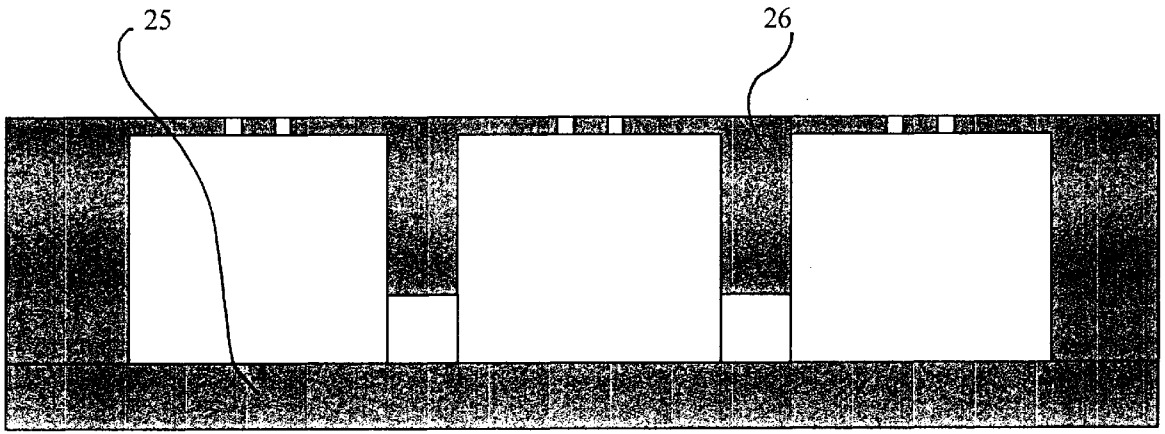

Other features and advantages of the liquid spray device according to the present invention will become clear from reading the following description, which is given solely by way of a non-limitative example thereby referring to the attached drawings in which:

FIG. 1 is a schematic cross-section of a first embodiment of the liquid droplet spray device according to the present invention, FIG. 2 is a schematic cross-section of a second embodiment of the liquid droplet spray device according to the present invention FIG. 3 shows an example of a nozzle body suitable for the liquid droplet spray device according to the present invention, and FIG. 4 shows another example of a nozzle body suitable for the liquid droplet spray device according to the present invention.

An example of a first preferred embodiment will be described hereafter. The present invention thus concerns a liquid droplet spray device for atomising a liquid substance. FIG. 1 shows a cross-section of the first embodiment. The liquid droplet spray device is indicated by general reference numeral 1 and consists in this example of a housing comprising a first substrate 2 and a second substrate 3. First substrate 2 preferably consists of plastic and is upside-down U-shaped. Second substrate 3 is preferably made of stainless steel and is disk-shaped having a thickness of around 20 to around 200 μm and having an aperture 3*a* in its centre. Of course, this second substrate need not be round, but could also be square or rectangular. The aperture is then simply positioned in the middle section.

Second substrate 3 closes the "U" of first substrate 2 so that within the housing, i.e. between the bottom surface of first substrate 2 and the top surface of second substrate 3, an empty space or chamber 4 is created for receiving a liquid substance. This liquid substance could be a medicament, a fragrance or any other liquid that may be atomised.

A nozzle body 5 is further provided and is arranged in a suitable manner to be in direct contact with any liquid substance in space 4. Nozzle body 5 is positioned in this example on top of second substrate 3 to cover the aperture in the middle section of the second substrate 3 and is adhered thereto.

As such, the space or chamber 4 is closed off by the arrangement of first substrate 2, second substrate 3 and nozzle body 5. In fact, the bottom surface of first substrate 2 and the top surface of nozzle body 5 are arranged such as to create a small gap section, referenced 4*a*, between the bottom surface of first substrate 2 and the top surface of nozzle body 5.

A disk-shaped vibrating element, such as a piezoelectric element 6 is disposed on second substrate 3 and is adhered to the bottom surface thereof. This piezoelectric element also has an aperture 6*a* at its centre which is concentric with aperture 3*a* of second substrate 3. Piezoelectric element 6 is arranged so as to transmit vibrations to second substrate 3 as well as to the liquid substance contained in space 4, e.g. in a manner as known from the above-mentioned document EP-A-0 923 957. As mentioned above, stainless steel is preferred for the second substrate due to the fact that its flexibility and elasticity resembles that of silicon. Thus, in this way, piezoelectric element 6 can transmit vibrations to the stainless steel sheet in a similar manner as it transmits vibrations to the silicon substrate of EP-A-0 923 957. The liquid substance will then, in the conventional manner, undergo the vibrations and the liquid substance that is present in the gap section 4*a* will cause a thinner section of nozzle body 5, the nozzle membrane section, to vibrate too resulting in the liquid being expelled as a spray of droplets.

In order to allow the liquid substance to enter space or chamber 4, suitable inlet means 7 are provided for connecting an external liquid reservoir, not shown, to the liquid droplet spray device. In this example, the inlet means consist of channels traversing first substrate 2. Further appropriate conventional connecting means may be provided to link inlet means 6 to the external reservoir.

As can be seen in FIG. 1, the nozzle body is arranged on the top surface of second substrate 3 over aperture 3*a* and thus creates gap section 4*a* of chamber 4 between nozzle body 5 and first substrate 2. When piezoelectric element 6 vibrates the liquid contained in chamber 4, due to this gap section 4*a*, the liquid substance will be compressed resulting in it being readily expelled trough nozzle membrane, in a direction as shown by the arrows, and as will be explained in more detail later.

Nozzle body 5 preferably consists of silicon and has thicker side sections 5*a* and a thinner middle section 5*b*. This thinner middle section 5*b* constitutes the nozzle membrane 5*b*. The thicker sections 5*a* provide a certain rigidity to the body to avoid it breaking when undergoing the vibration generated by piezoelectric element 6 and transmitted by the liquid substance. The thinner middle section, i.e. the nozzle membrane 5*b* contains outlet means allowing the liquid substance to exit from chamber 4, as mentioned above. In fact, when the liquid contained in space 4 is excited by vibrating element 6 at an appropriate frequency, in the present case around 300 kHz, and under an appropriate low pressure, it will be ejected as a spray of droplets through the outlet means with a very low exit velocity. The outlet means, not shown, consists of at least one outlet nozzle and at least one output channel connecting space 4 to each outlet nozzle, as will be explained in more detail hereafter. The nozzle body 5 and its outlet means may be manufactured by etching, e.g. by wet-etching or anisotropic etching or the like in a manner as explained in the above-mentioned document EP-A-0 923 957. Thus, the middle section of nozzle body 5 may be etched away to obtain a cavity and the thinner membrane section 5*b*. In this example, the nozzle body is arranged such that the cavity-side is positioned adjacent second substrate 3. However, it is also possible to position nozzle body 5 in an upside-down manner, i.e. such that the flat side is adjacent the top surface of second substrate 3.

Thus, in the conventional manner, each output channel in nozzle membrane 5*b* has straight, non-tapered sidewalls and connects space 4 to an outlet nozzle. In an alternative embodiment, the output channel could be stepped-shaped, i.e. have a wider and a narrower cross-section portion, as explained in co-pending application EP 01 103 653.0, also in the name of the present applicant. The wider cross-section portion is then arranged adjacent the chamber, whereas the narrower cross-section portion is arranged adjacent the outlet nozzle.

FIG. 2 shows a second embodiment of the liquid droplet spray device according to the present invention. Similar parts as in the first embodiment are indicated by similar reference numerals and will thus not be described further.

This second example shows liquid droplet spray device, indicate by general reference 10 having a housing comprising a first substrate 12 and a second substrate 3, which is similar to that of the first embodiment. Similar inlet means 7 as in the first embodiment are again provided allowing a liquid substance to enter space or chamber 4.

Again, a nozzle body 5, identical to that of the first embodiment is provided and is aligned with the aperture 3*a* of second substrate 3. However, in this embodiment, nozzle body 5 is disposed below second substrate 3 and is adhered to the bottom surface thereof. Again, as shown, the flat side of nozzle body 5 is adjacent the bottom surface of second substrate 3, but the nozzle body can also be arranged upside-down so that its cavity side is arranged adjacent the bottom surface of second substrate 3.

Piezoelectric element 6 is again adhered to the bottom surface of the second substrate 3, and surrounds the nozzle body 5, i.e. nozzle body 5 is arranged within the centre aperture 6*a* of piezoelectric element 5. As such a very compact device may be obtained.

In this example, first substrate 12 is again upside-down U-shaped. But the bottom inner surface of the "U"-section is not flat, but instead has a projection 12*a* at its centre. This projection is arranged concentric with the aperture 3*a* of second substrate 3 and the thinner membrane section 5*b* of nozzle body 5 and is shaped so that a restricted area is formed in chamber 4 having a smaller height so as to create a gap portion 14*b* between the bottom surface of the projection 12*a* and the top surface of the nozzle body 5.

As may be understood from the above embodiments, it is possible to reduce the use of silicon as much as possible, i.e. to the nozzle body. Thus, a cheaper device may be obtained by using suitable other materials for the remaining parts. Indeed, thanks to the specific arrangement of the housing, and to the use of a stainless steel disk as second substrate 3, and to the plastic first substrate 2, a sufficiently precise and rigid, thus reliable, device may be obtained.

As mentioned above, nozzle body 5 may be manufactured as explained the above-referenced document EP-A-0 923 957. However, it is also possible to manufacture this nozzle body in another manner. Two examples of such are provided hereafter.

FIG. 3 shows a first example. Nozzle body 5 consists of a silicon substrate 15. On its top surface, nitride is deposited in a multi-layered structure 16. This multi-layered structure 16 is used to form the thinner middle section, i.e. the actual nozzle membrane. Thus, the straight output channels are etched in the nitride layer, for example by using Reactive Ion Etching (RIE). This sandwiched layer may be about 5 $\mu$m thick. After this, the silicon body 15, which serves only for structural stability, is first etched away, then polished to obtain the desired thickness, which may e.g. between 20 and 100 $\mu$m depending on the intended use of the liquid droplet spray device.

FIG. 4 shows an alternative manner of manufacturing nozzle body 5. In this example, the nozzle body consists of a support body 25 that may consist of e.g. silicon, glass or ceramic or the like. On this support substrate 25 a photoresist, preferably SU-8, is deposited, e.g. by way of spin-coating. Then the support body, which is in fact a sacrificial support structure is etched away. After this, the photo-resist is photo-structured in a conventional manner by using UV radiation to obtain the thicker sections of nozzle body 5. Finally, the output channels are formed in the thinner membrane section by using RIE or even DRIE (Deep RIE) etching or even by laser cutting.

Having described a preferred embodiment of this invention, it will now be apparent to one of skill in the art that other embodiments incorporating its concept may be used. It is felt, therefore, that this invention should not be limited to the disclosed embodiment, but rather should be limited only by the scope of the appended claims.

For example, the same liquid droplet spray device may not only be used for atomising medication for respiratory therapies, but it may generally be used for atomising different physico-chemical compositions, e.g. using aqueous or alcoholic or other liquid substances.

What is claimed is:

1. Liquid droplet spray device for atomising a liquid substance, comprising:

a housing comprising a first substrate, a disk-shaped second substrate having a central aperture, a nozzle body arranged on the second substrate over the central aperture, and a space enclosed by said first and second substrates and said nozzle body for containing the liquid substance;

means for supplying said liquid substance to said space;

a nozzle membrane arranged in said nozzle body and comprising at least one outlet nozzle and at least one output channel connecting said space to each of said at least one outlet nozzle, said at least one outlet nozzle and said at least one output channel having a tightly-toleranced, straight, non-tapered shape; and a vibrating element disposed to vibrate liquid in said space so as to eject said liquid substance as a spray through said at least one outlet nozzle of said nozzle membrane;

wherein the bottom surface of said first substrate and the top surface of said nozzle body are arranged such as to create a small gap section of said space between the bottom surface of said first substrate and the top surface of said nozzle body.

2. Liquid droplet spray device according to claim 1, wherein said nozzle body consists of a silicon body and a nitride layer, the nitride layer being deposited onto the silicon to form said membrane section.

3. Liquid droplet spray device according to claim 2, wherein said nozzle body consists of a photo-resist material that is photo-structured to obtain said nozzle membrane.

4. Liquid droplet spray device according to claim 1, wherein said nozzle body consists of a photo-resist material that is photo-structured to obtain said nozzle membrane.

5. Liquid droplet spray device according to claim 4, wherein said photo-resist material is SU-8.

* * * * *